US005201698A

United States Patent [19]

Kobayashi

[11] Patent Number: 5,201,698

[45] Date of Patent: Apr. 13, 1993

[54] PULL TAB FOR OPENING BEVERAGE CARTONS AND METHOD OF OPENING

[76] Inventor: Tunetoshi Kobayashi, 15-7, Nagasaki 2-chome, Toshima-ku, Tokyo 171, Japan

[21] Appl. No.: 460,065

[22] PCT Filed: Feb. 9, 1989

[86] PCT No.: PCT/JP89/00128

§ 371 Date: May 15, 1991

§ 102(e) Date: May 15, 1991

[87] PCT Pub. No.: WO89/12004

PCT Pub. Date: Dec. 14, 1989

[30] Foreign Application Priority Data

Jun. 8, 1988 [JP] Japan ..... 63-139441

[51] Int. Cl.[5] ..... B31B 1/90; B65D 5/74

[52] U.S. Cl. ..... 493/87; 493/102; 493/116; 493/963

[58] Field of Search ..... 493/87, 102, 116, 214, 493/331, 334, 963

[56] References Cited

U.S. PATENT DOCUMENTS

| | | | |
|---|---|---|---|
| 2,395,352 | 2/1946 | Staude et al. | 493/87 |
| 2,891,453 | 6/1959 | Bergstein et al. | 493/87 |
| 3,145,630 | 8/1964 | Moore | 493/87 |
| 3,555,764 | 1/1971 | Dowling | 493/116 |
| 3,605,578 | 9/1971 | Sternau | 493/87 |
| 4,464,154 | 8/1984 | Ljungcrantz | 493/963 |

FOREIGN PATENT DOCUMENTS 58-24721 2/1983 Japan .

*Primary Examiner*—William E. Terrell
*Attorney, Agent, or Firm*—Levy, Zito & Grandinetti

[57] ABSTRACT

A paper package for use with milk, fruit juice or the like beverage products having a pulling-to-open member of polyethelene terephthalate and polyester film and an adhesive of synthetic rubber such as nitrile rubber for the provision of a positive opening effect of such packages.

2 Claims, 1 Drawing Sheet

PULL TAB FOR OPENING BEVERAGE CARTONS AND METHOD OF OPENING

FIELD OF THE INVENTION

The present invention relates generally to the handling of paper or cardboard packages, and more particularly to the useful art of opening paper or cardboard packages for use with drinkable liquid products or beverages such as milk, fruit juice or the like. These beverage cartons are prepared in the form of enclosed containers using materials such as adhesive film or sheet classified as belonging to the International Patent Classification, Section B, Class B67B.

BACKGROUND OF THE INVENTION

While the prior art is replete with paper packages which have been proposed to employ a pulling tab or tongue provided at the top or other portion of such packages to be pulled outwardly for opening them to pour out or drink the contents thereof, they have in practice such as pulling means closed physically either by using a rivet, peg or the like, or by way of adhesive or welding, which has however been left short of any further details either in the manner of attachment or adhesion of such opening means or in their material to practice, and which have been of mere useless casual ideas, and so, there is made available no practical way of testing for the reduction to practice of such packages.

Taking for example certain of such propositions, Japanese Utility Model Laid-open Applications Nos. 103,428/1978 and 91,425/1988 have merely proposed the provision of packages with additional attachment, and Japanese Utility Model No. 131,338/1977 has suggested use of a tongue attachment which lacks any practical manner of attaching, all of which have presented no references to their material or composition of adhesives, and which would lead nothing to the practice of such arts with the lack of disclosure of inventive means or steps that would enable those who wish to do so.

In an attempt to cope with such uncertainty inherent to the prior art construction, the present invention is essentially directed to the provision of an efficient solution to the opening structure of paper for cardboard packages, particularly beverage cartons, with practical presentation of tongue material and composition of adhesive, which may readily be put to practice for the reliable and useful means for the opening of such packages, accordingly.

DISCLOSURE OF THE INVENTION

Therefore, this invention is directed to a useful improvement in the construction of paper or cardboard packages for use with drinkables or beverage products, which comprises a pulling-to-open tongue made of polyethylene terephthalate and such as nitrile rubber, so that the pulling tongue may positively be adhered to a layer of polyethylene which is adapted to totally cover up the surfaces of such packages, thereby to provide an ensured opening of the pulling-to-open tongues.

BRIEF DESCRIPTION OF THE DRAWINGS

In the accompanying drawings, like parts are designated by like reference numerals, and in which.

DETAILED DESCRIPTION OF THE DRAWINGS

Figure 3:
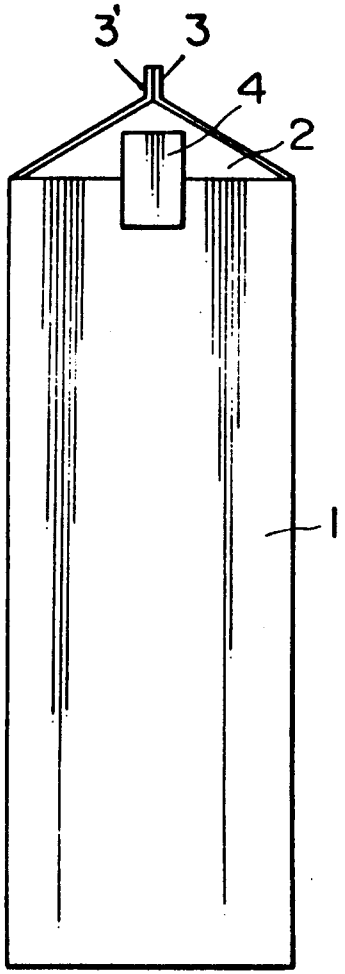
FIG. 3 is a similar front elevational view showing the embodiment of the present invention with the pull tab in its closed position.
Figure 2:
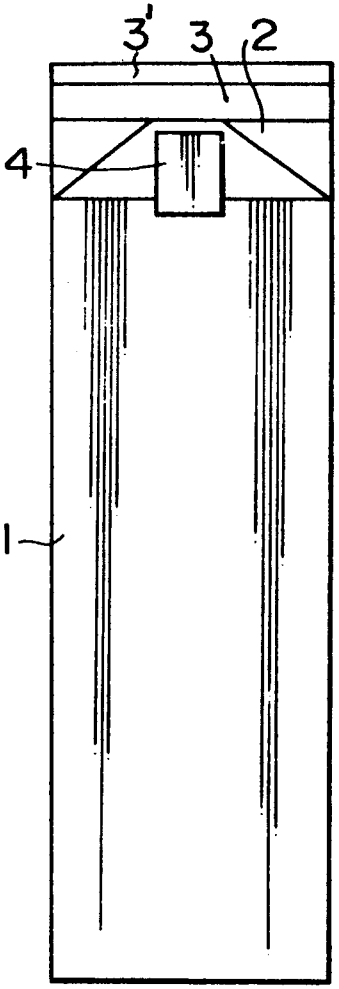
FIG. 2 is a front elevational view of the package depicted in FIG. 1 with its pull tab in a closed position by using adhesive.
Figure 1:
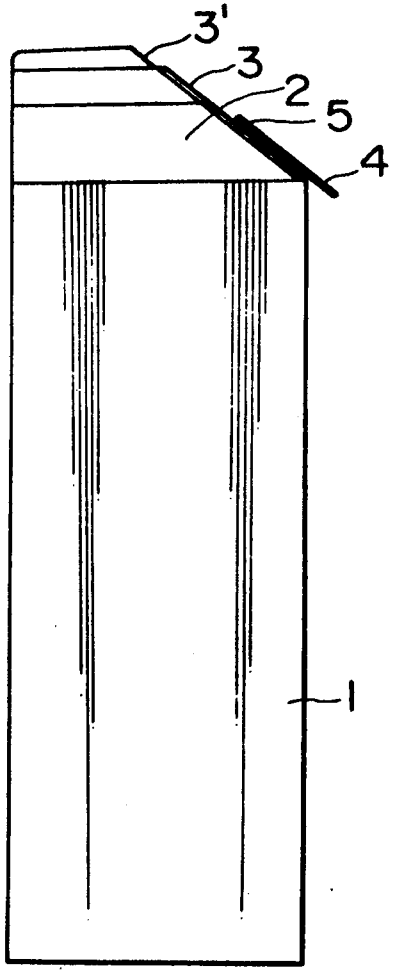
FIG. 1 is a side elevational view showing a package of the invention by way of a preferred embodiment thereof.

FIGS. 1 and 3 generally depict in a side elevational view a paper package for use with beverage products by way of a preferred embodiment of the present invention. The beverage cartons depicted in FIGS. 1 and 3 have a foldable opening member 2, that is secured by carton adhering members. The opening of foldable opening member 2 causes the opposed surfaces 3 and 3' to be separated to form an opening. The particular form that the opening member 2 takes is slightly different for each of the embodiments. FIG. 1 shows one embodiment wherein the foldable opening member 2 is in the form of a slope. FIG. 2 shows the preferred embodiment where the opposed surfaces of opening are in the form of a peak or gable.

According to the embodiment, as best seen in FIG. 2, there is a film strip or tongue member 4 with an upper leading end and a lower trailing end. The film strip 4 is preferably made from polyethelene terephthalate or polyester. The upper leading end of film strip 4 is adapted to be attached to the lower area of a foldable opening member 2 of a paper package 1 for use with beverages such as milk, fruit juice or the like. The opening member 2 is foldably put to its closing position in the manner known to those skilled in the art. In adhesive 5 which comprises as a principal component a synthetic rubber for adhesive use, is used to securely affix the upper leading end of film strip 4 to foldable opening member 2. Adhesive 5 is preferably nitrile rubber or the like and has a stronger adhesive or bonding strength than the force of adhesion rendered by the upper portion of the package, in particular the opposed surfaces 3, 3' and the foldable opening member 2. When in use, the paper package may readily be opened by manually pulling outwardly the film strip 4 so that the adhesion existing between the opposed surfaces, 3, 3' of the opening member 2 of the package 1 may be broken to cause the opening member to e pulled outwardly for use. With this construction and with this useful combination of the material of the closing member and the adhesive stated above, the liquid produce container package may be ready to storage and/or transportation to the points of sales.

As stated hereinbefore, by virtue of the best possible combination of the material of the closing member involved to be adhered to its closing position and the composition of adhesive to be applied, the present invention may be adapted extensively for the closing of a variety of types of paper packages on the distribution market.

It is to be understood that the appended claim is intended to cover all of such generic and specific features as are particular to the invention as disclosed herein and all statements relating to the scope of the invention, which as a matter of language might be said to fall thereunder.

I claim:

1. A method of opening a beverage carton wherein said beverage carton has a foldable opening member secured by carton adhering members, said method comprising the steps of:

supplying a film strip of a polymeric material, said film strip having an upper leading portion and a lower trailing portion and wherein said film strip is a polyethylene terephthalate film strip;

applying an adhesive to said upper leading portion of said film strip, wherein said adhesive contains a nitrile rubber and has a stronger bonding strength than the carton adhering members;

placing the adhesive coated portion of said film strip in contact with said opening foldable member of said carton and adhering in place; and pulling on the lower trailing portion of said adhered film strip to open said foldable opening member of said carton.

2. A method of opening a beverage carton wherein said beverage carton has a foldable opening member secured by carton adhering members, said method comprising the steps of:

supplying a film strip of a polymeric material, said film strip having an upper leading portion and a lower trailing portion and wherein said film strip is a polyester film strip;

applying an adhesive to said upper leading portion of said film strip, wherein said adhesive contains a nitrile rubber and has a stronger bonding strength than the carton adhering members;

placing the adhesive coated portion of said film strip in contact with said opening foldable member of said carton and adhering in place; and pulling on the lower trailing portion of said adhered film strip to open said foldable opening member of said carton.

* * * * *